United States Patent [19]

Schuurman et al.

[11] Patent Number: 4,778,076

[45] Date of Patent: Oct. 18, 1988

[54] CONTAINER

[75] Inventors: Pieter J. Schuurman; Franciscus J. R. Könings; Heinz Voetter; Ian Poll, all of The Hague, Netherlands

[73] Assignee: Shell Internationale Research Maatschappij B.V., The Hague, Netherlands

[21] Appl. No.: 916,328

[22] Filed: Oct. 7, 1986

[30] Foreign Application Priority Data

Oct. 31, 1985 [GB] United Kingdom ..... 8526811

[51] Int. Cl.[4] ..... B65D 6/34

[52] U.S. Cl. ..... 220/72.1; 220/71

[58] Field of Search ..... 220/72.1, 71

[56] References Cited

U.S. PATENT DOCUMENTS 1,891,518 12/1932 Wright ..... 220/72.1
4,476,988 10/1984 Tanner ..... 220/72.1
4,593,832 6/1986 Gerhard ..... 220/72.1

FOREIGN PATENT DOCUMENTS 2816845 10/1979 Fed. Rep. of Germany ..... 220/72.1
2013624 8/1979 United Kingdom ..... 220/72.1

*Primary Examiner*—Joseph Man-Fu Moy
*Attorney, Agent, or Firm*—Jones, Tullar & Cooper

[57] ABSTRACT

Container suitable for preheating, retorting and cooling of shale under pressure comprising a vessel (2) and a primary stiffener system comprising side stiffeners (16, 17), a top stiffener (20) and a stiffener connecting system (21), wherein the primary stiffener system (11) prevents excess bending of the walls (3, 4, 7, 8) of the vessel (2), and wherein, when heated, the stiffener connecting system (21) forces the primary stiffener system (11) to give way so as to allow some expansion of the walls of the vessel (2).

11 Claims, 4 Drawing Sheets

FIG. 6
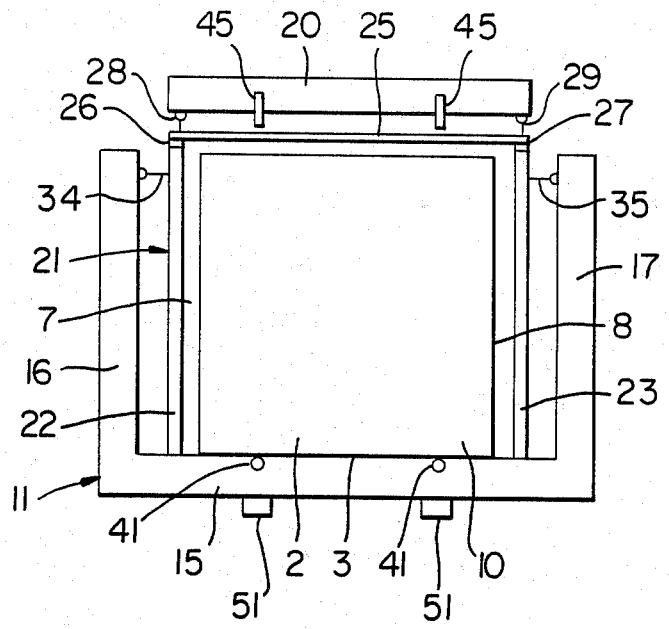
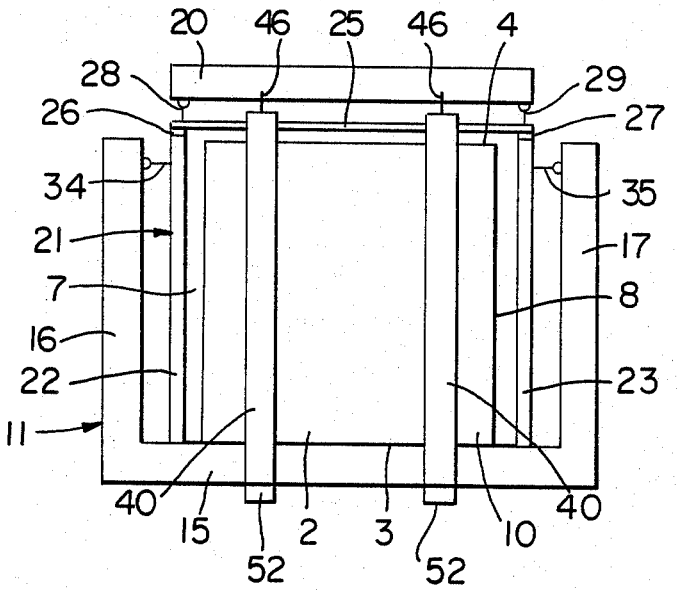
FIG. 7

CONTAINER

The present invention relates to a container including a vessel having a bottom wall, a top wall, two side walls and two end walls. The walls of the vessel can be planar or substantially planar for example in the case of corrugated walls.

It is an object of the present invention to provide a container for the storage of a dense material, such as sand, and for the storage of material under pressure, for example at an internal pressure between 1.1 and 1.5 bar.

It is a further object of the present invention to provide a container for the storage of hot material, wherein the temperature of the material stored can vary from place to place.

To this end the container according to the invention includes a vessel having a bottom wall, a top wall, two side walls and two end walls, and a primary stiffener system comprising a bottom stiffener supporting the bottom wall, two side stiffeners connected to the bottom stiffener and arranged at either side of the vessel free from the side walls, a top stiffener arranged above the top wall, and a stiffener connecting system, which stiffener connecting system comprises two side connecting bars extending between the side walls and the side stiffeners and a top connecting bar extending between the top stiffener and the top wall, wherein the end parts of the top connecting bar are indirectly connected to the end parts of the top stiffener and to the upper end parts of the side stiffeners, wherein the lower ends of the side connecting bars are connected to the bottom stiffener, and wherein the upper ends of the side connecting bars are connected to the end parts of the top connecting bar.

The function of the primary stiffener system is the prevention of excess bending of the side walls and the bottom wall of the vessel caused by the pressure on these walls by the dense material stored in the vessel. If, moreover, material is stored in the vessel under pressure the primary stiffener system will prevent excess bending of these walls due to the pressure acting thereon and it will prevent excess bending of the top wall.

If there is hot material stored in the vessel, the walls will be heated and consequently, if not restricted, they expand. Restricting this expansion will result in high stresses in the walls. In order to avoid the occurrence of high stresses in the walls and to maintain the function of the primary stiffener system, the primary stiffener system further comprises a stiffener connecting system of which the connecting bars are arranged nearer to the walls of the vessel than the stiffeners. The bars will be heated by the hot material stored in the vessel and they expand. Consequently the upper ends of the side stiffeners are pushed outwardly and the top stiffener is pushed upwardly, thus allowing such an expansion of the walls of the vessel that the stresses in the walls will remain acceptable.

The container according to the invention can suitably be used for preheating, retorting and cooling of shale.

The invention will now be described in more detail by way of example with reference to the drawings wherein FIG. 1 shows schematically a side view of a container according to the invention;

FIG. 6 shows schematically a cross-section of the container of FIG. 4 along the line VI—VI; and FIG. 7 shows schematically an end view of the container of FIGS. 4 and 6.

Figure 1:
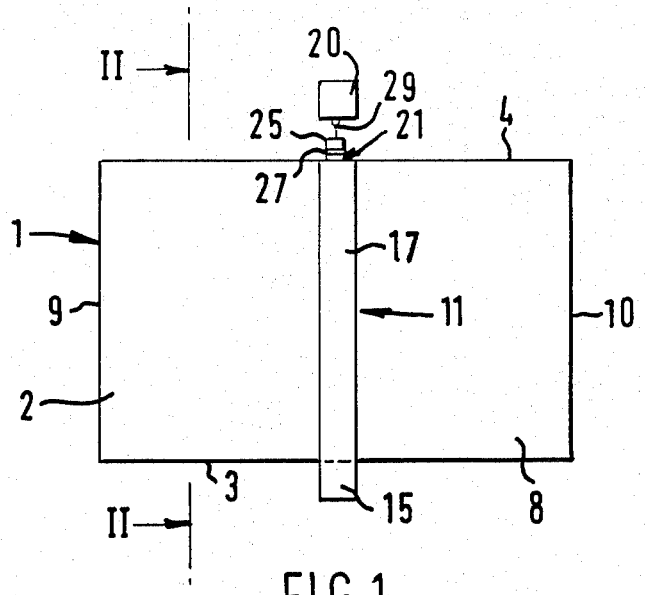
Figure 2:
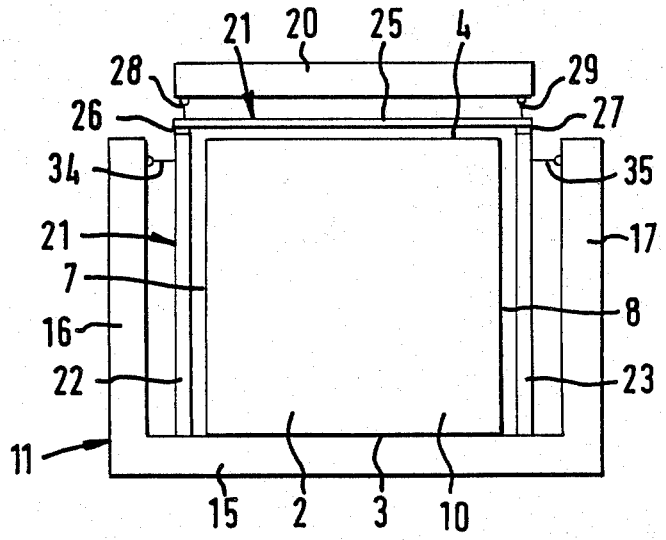
FIG. 2 shows schematically a cross-section of the container of FIG. 1 along the line II—II.

Reference is first made to FIGS. 1 and 2. The container 1 includes a vessel 2 having a bottom wall 3, a top wall 4, two side walls 7 and 8, two end walls 9 and 10, and a primary stiffener system 11.

The primary stiffener system 11 comprises a bottom stiffener 15 supporting the bottom wall 3, two side stiffeners 16 and 17 connected to the bottom stiffener 15 and arranged at either side of the vessel 2 free from the side walls 7 and 8, a top stiffener 20 arranged above the top wall 4, and a stiffener connecting system 21.

The stiffener connecting system 21 comprises two side connecting bars 22 and 23 connected to the bottom stiffener 15, wherein the side connecting bar 22 extends between the side wall 7 and the side stiffener 16, and wherein the side connecting bar 23 extends between the side wall 8 and the side stiffener 17.

The stiffener connecting system 21 further comprises a top connecting bar 25. The end parts of the top connecting bar 25 are connected to the upper end parts of the side connecting bars 22 and 23 by the joints 26 and 27. In addition, the end parts of the top connecting bar 25 are indirectly connected to the end parts of the top stiffener 20 by means of vertical links 28 and 29 hingeably connected to the end parts of the top stiffener 20. Furthermore the end parts of the top connecting bar 25 are indirectly connected to the upper end parts of the side stiffeners 16 and 17 by means of horizontal links 34 and 35 extending between the upper ends of the side connecting bars 22 and 23 the upper ends parts of the side stiffeners 16 and 17.

For the sake of clarity, not shown in FIGS. 1 and 2 is a means preventing the lateral movements of the top stiffener 20.

During normal operation the vessel 2 is loaed with dense material. The pressure of the dense material acting against the side walls 7 and 8 causes these walls to bend outwardly and as a result the side walls will contact the side connecting bars 22 and 23 and the side connecting bars 22 and 23 will bend. An excess outward movement of the side walls 7 and 8 is prevented by the side stiffeners 16 and 17. In addition, bending of the bottom wall 3 is prevented by the bottom stiffener 15.

If the vessel 2 is loaded with material under pressure, the pressure will cause, in addition to bending of the side walls 7 and 8 and the bottom wall 3, outward bending of the top wall 4. As a result thereof the top wall 4 will contact the top connecting bar 25, which will bend. An excess outward movement of the top wall 4 is prevented by the top stiffener 20.

Furthermore, if the material stored in the vessel 2 is hot, the walls of the vessel will be heated and, moreover, the connecting bars 22, 23 and 25 will be heated. Thus the side connecting bars 22 and 23 will expand and push the top connecting bar 25 and, consequently, the top stiffener 20 upwardly, and moreover the top connecting bar 25 will expand and push the upper ends of the side stiffeners 16 and 17 outwardly. As a result thereof the side walls 7 and 8 are allowed to expand vertically and the top wall 4 is allowed to expand in a transverse direction so as to reduce the stresses in the vessel walls.

To improve the heat transfer from the hot material in the vessel 2 to the connecting bars 22, 23 and 25, the side connecting bars 22 and 23 can be arranged against the side walls 7 and 8, and the top connecting bar 25 against the top wall 4. If a wall is a corrugated wall having vertical corrugations, a connecting bar can be arranged in such a corrugation.

In the embodiment as known with reference to FIGS. 1 and 2, the primary stiffeners system 11 is arranged perpendicular to the side walls 7 and 8. In an alternative embodiment of the invention, a primary stiffener can be arranged perpendicular to the end walls 9 and 10.

The joints 26 and 28 can be rigid elements or hinges, and the side connecting bars 22 and 23 can be rigidly connected to the bottom support 15 or hingeably. The vertical and horizontal links 28, 29, 34 and 35 can be connected to the joints 26 and 28.

Figure 3:
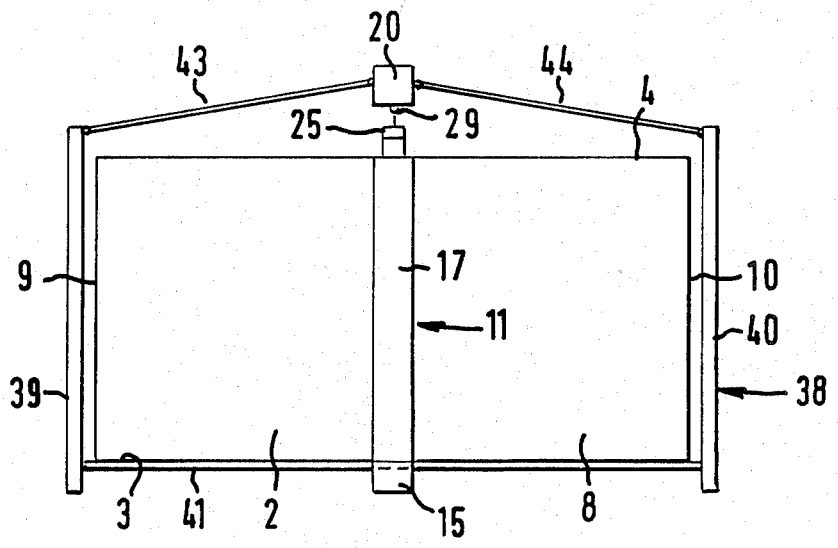
FIG. 3 shows schematically a side view of an alternative container according to the invention.

To restrict the bending of the end walls 9 and 10, the container further includes a secondary stiffener system 38 (see FIG. 3). The secondary stiffener system 38 comprises two end stiffeners 39 and 40 arranged at either end of the vessel 1 near the middle of each end wall, wherein the lower ends of the end stiffeners 39 and 40 are connected to each other by means of a lower connecting bar 41 passing through a passage (not shown) between the bottom wall 3 and the bottom support 15, and wherein the upper ends of the end stiffeners 39 and 40 are indirectly connected to each other by means of the additional top connecting bars 43 and 44 connected to the top stiffener 20.

If the vessel 2 contains hot material, the lower connecting bar 41 and the additional top connecting bars 43 and 44 are heated and will expand causing the end stiffeners 39 and 40 to move away from each other and allow the walls 3, 4, 7 and 8 of the vessel to expand in the longitudinal direction so as to reduce the stresses in these walls.

To improve the transfer of heat thereto the additional top connecting bars 43 and 44 can be arranged against the top wall 4, and the lower connecting bar 41 can be arranged against the bottom wall. In the case of a corrugated wall having corrugations in the direction of a connecting bar, the connecting bar can be arranged in such a corrugation.

To prevent transverse movements of the upper parts of the end stiffeners 39 and 40, the upper parts of each of the end stiffeners can be connected by means of two bars (not shown) to the end parts of the top stiffener 20.

Furthermore, instead of linking the upper parts of the end stiffeners 39 and 40 to the top stiffener, they can be linked to the top connecting bar 25.

Figure 4:
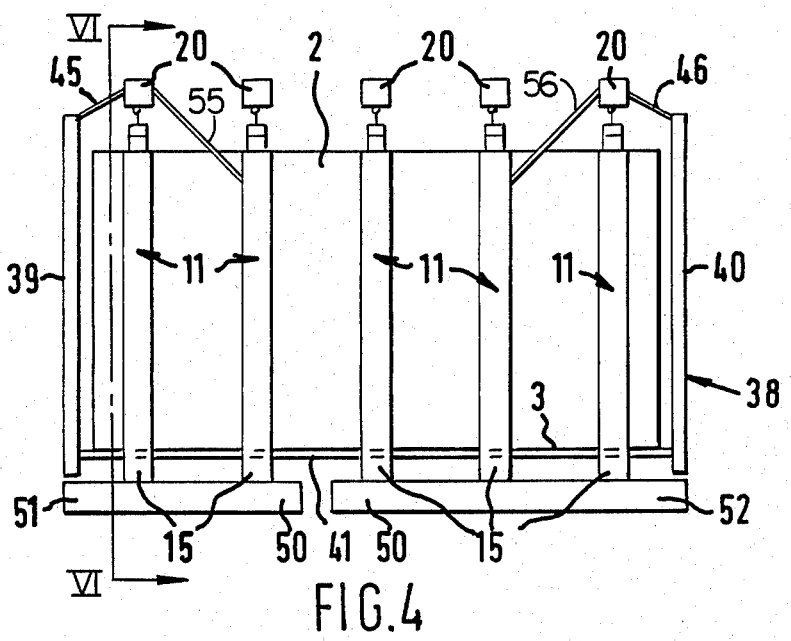
FIG. 4 shows schematically a side view of a second alternative container according to the invention.

For larger vessels the container should include two or more primary stiffener systems arranged axially spaced apart along the vessel. Reference is now made to FIGS. 4, 6 and 7 showing an embodiment of the invention wherein the container comprises five primary stiffener systems 11. For the sake of clarity not all elements shown in FIG. 4 are indicated by a reference sign.

The lower ends of the end stiffeners 39 and 40 pertaining to the secondary stiffener system 38 are connected to each other by means of the lower connecting bar 41 passing through passages (not shown) between the bottom wall 3 of the vessel 2 and the bottom stiffener 15. The upper ends of the end stiffeners 39 and 40 are connected to the top stiffeners 20 pertaining to the primary stiffener systems 11 arranged near the ends of the vessel 2 by means of links 45 and 46 hingeably connected to the top stiffeners 20.

Moreover the container further comprises two parallel support members 50, one of which is shown in FIG. 4. The support members 50 support the bottom stiffeners 15. Each support member 50 comprises two support beams 51 and 52 arranged one after the other, wherein the support beam 51 supports two bottom stiffeners 15 and the support beams 52 supports three bottom stiffeners 15, to allow axial expansion of the vessel 2.

The top stiffeners 20 situated at the two ends of the container may include bars 55 and 56 which connect the reflective top stiffeners 20 to their adjacent primary stiffeners 11.

The container can comprise three or more parallel support members, for example five or six. Moreover, a support member can comprise more than two support beams arranged one after the other, wherein each support beam supports at least two bottom stiffeners, for example each support beam supports three bottom stiffeners. The support beams can be provided with elements (not shown) allowing the support beam with respect to a frame (not shown) supporting the container.

Figure 5:
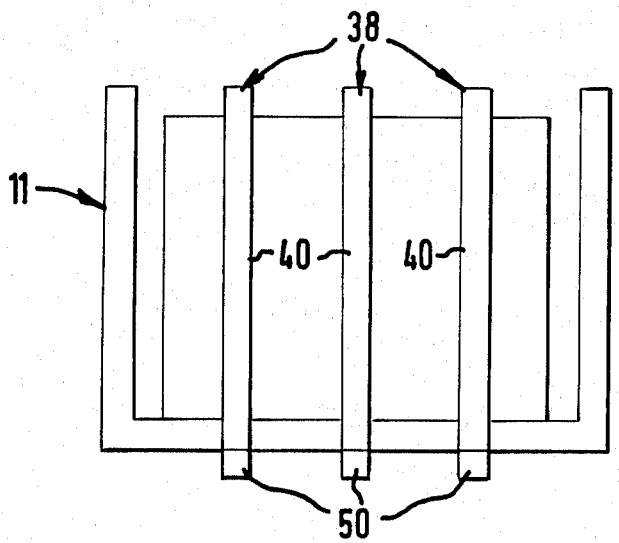
FIG. 5 shows schematically an end view of a third alternative container according to the invention.

Reference is made to FIG. 5 showing an end view of a container, wherein for the sake of clarity the top stiffener and the stiffener connecting system pertaining to the primary stiffener 11 have been omitted. The container comprises three parallel support members 50 and three secondary stiffener systems 38, and the end of the support members 50 are connected to the lower ends of the end stiffeners 40 pertaining to the secondary stiffener systems 38.

We claim:

1. Container including a rectangular vessel having a bottom wall, a top wall, two side walls and two end walls, and a primary stiffener system comprising a bottom stiffener supporting the bottom wall, two side stiffeners connected to the bottom stiffener and extending vertically at either side of the vessel free from the side walls, a top stiffener arranged above the top wall, and free from the top wall, and a stiffener connecting system, which stiffener connecting system comprises two side connecting bars extending vertically between the side walls and the side stiffeners and a top connecting bar extending horizontally between the top stiffener and the top wall, wherein the end parts of the top connecting bar are indirectly connected to the end parts of the top stiffener and to the upper end parts of the side stiffeners, wherein the lower ends of the side connecting bars are connected to the bottom stiffener, and wherein the upper ends of the side connecting bars are connected to the end parts of the top connecting bar.

2. Container as claimed in claim 1, further including a secondary stiffener system comprising two end stiffeners arranged at either end of the vessel, wherein the lower ends of the end stiffeners are connected to each other by means of a lower connecting bar, and wherein the upper ends of the end stiffeners are indirectly connected to each other.

3. Container as claimed in claim 2, wherein the upper ends of the end stiffeners are connected to the top stiffener by means of additional top connecting bars.

4. Container as claimed in claim 1, which container comprises two or more primary stiffener systems, arranged axially spaced apart along the vessel, one primary stiffener system being arranged near one end of the vessel and an other being arranged near the opposite end of the vessel.

5. Container as claimed in claim 4, further comprising a secondary stiffener system comprising two end stiffeners arranged at either end of the vessel, wherein the lower ends of the end stiffeners are connected to each other by means of a lower connecting bar, and wherein the upper ends of the end stiffeners are connected to the top stiffeners pertaining to the primary stiffener systems arranged near the ends of the vessel by means of top connecting bars.

6. Container as claimed in claim 4 or 5, wherein the end parts of the top stiffeners pertaining to each of the two primary stiffener systems arranged near the ends of the vessel are connected to the upper parts of the side stiffeners pertaining to the primary stiffener system adjacent thereto.

7. Container as claimed in claim 4 or 5, further comprising at least two parallel support members arranged in the, longitudinal direction and supporting the bottom stiffeners.

8. Containers as claimed in claim 7, wherein a support member comprises two or more support beams arranged one after the other, each support beam supporting at least two bottom stiffeners.

9. Container as claimed in anyone of the claims 7, wherein an end of a support member is connected to the lower end of an end stiffener.

10. Container as claimed in claim 2 or 5, which container comprises two or more secondary stiffener systems arranged transversely spaced apart along the vessel.

11. Container as claimed in claim 6, further comprising at least two parallel support members arranged in the longitudinal direction and supporting the bottom stiffeners.

* * * * *